US005170552A

United States Patent [19]

Swiderski et al.

[11] Patent Number: 5,170,552

[45] Date of Patent: Dec. 15, 1992

[54] METHOD OF MANUFACTURING A ROLLING TOWER SCAFFOLD

[75] Inventors: Paul R. Swiderski, Scott County; Paul J. Seadler, Jefferson County, both of Ky.

[73] Assignee: Emerson Electric Co., St. Louis, Mo.

[21] Appl. No.: 702,280

[22] Filed: May 17, 1991

Related U.S. Application Data

[62] Division of Ser. No. 413,694, Sep. 28, 1989, Pat. No. 5,069,309.

[51] Int. Cl.[5] ..... B21D 39/00

[52] U.S. Cl. ..... 29/523; 29/512; 29/243.5; 29/243.517; 72/370

[58] Field of Search ..... 29/506, 509, 510, 511, 29/512, 515, 520, 523, 243.517; 72/370; 403/277, 282; 188/106, 113, 118, 119, 178, 228

[56] References Cited

U.S. PATENT DOCUMENTS

| | | | |
|---|---|---|---|
| 3,119,435 | 1/1964 | Greenman | 182/228 X |
| 3,327,385 | 6/1967 | Shaver | 182/228 |
| 3,396,817 | 8/1968 | Perry | 182/19 |
| 3,426,867 | 2/1969 | Berger | 182/228 |
| 4,219,102 | 8/1980 | Ducresot et al. | 182/228 X |
| 4,261,436 | 4/1981 | Stillman, Jr. | 182/228 X |
| 4,263,984 | 4/1981 | Masuda et al. | 182/19 X |
| 4,606,214 | 8/1986 | Miyazaki | 72/370 X |
| 4,656,721 | 4/1987 | Werner | 29/523 |
| 4,698,896 | 10/1987 | Osterwald et al. | 29/523 |
| 4,972,571 | 11/1990 | Cole et al. | 29/523 |

FOREIGN PATENT DOCUMENTS

| | | |
|---|---|---|
| 556581 | 4/1957 | Belgium . |
| 564789 | 2/1958 | Belgium . |
| 3602331 | 8/1986 | Fed. Rep. of Germany . |
| 844074 | 8/1960 | United Kingdom . |
| 1229391 | 4/1971 | United Kingdom . |

*Primary Examiner*—Joseph M. Gorski
*Assistant Examiner*—S. Thomas Hughes
*Attorney, Agent, or Firm*—Polster, Lieder, Woodruff & Lucchesi

[57] ABSTRACT

Climbing apparatus including a rolling tower support platform, and method and tooling for the same wherein one of two spaced double walls of each of opposed tower rails of a tower ladder is snugly gripped by detents formed on the end portions of spaced rail rungs and the extremities of the rungs are flared, the rails including expanded bottoms for snap lock and threaded lock assembly with unique caster boxes of a caster wheel assembly for the tower rails and a support platform mounted on the rails with slidable carriages having double grip and threaded pin tightening arrangements and also having sockets to receive collapsible hand rail assemblies with unique hinges for gates thereof.

14 Claims, 12 Drawing Sheets

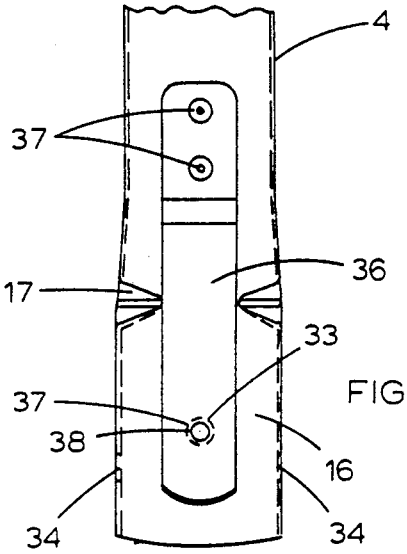
FIG. 14
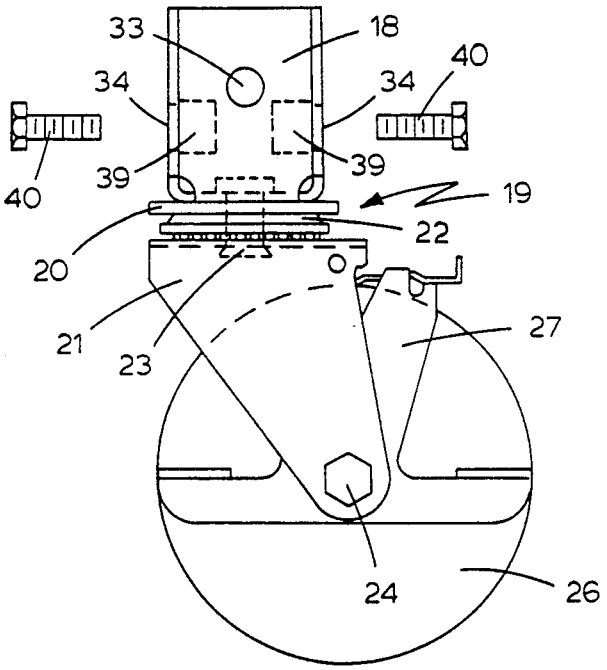
FIG. 15
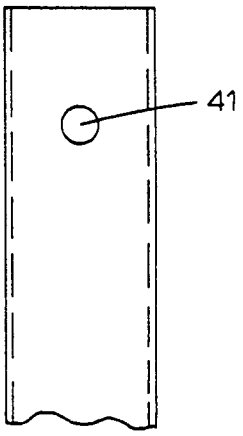
FIG. 16
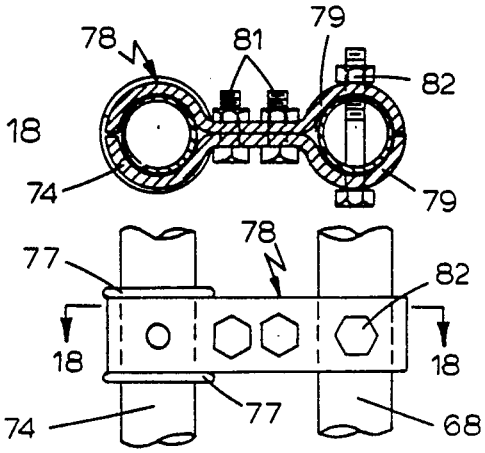
FIG. 18
FIG. 17

FIG. 19
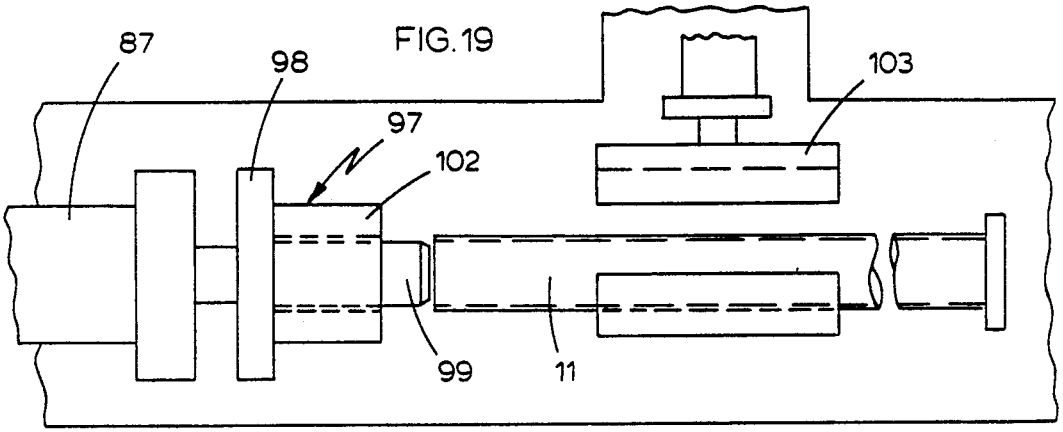
FIG. 20
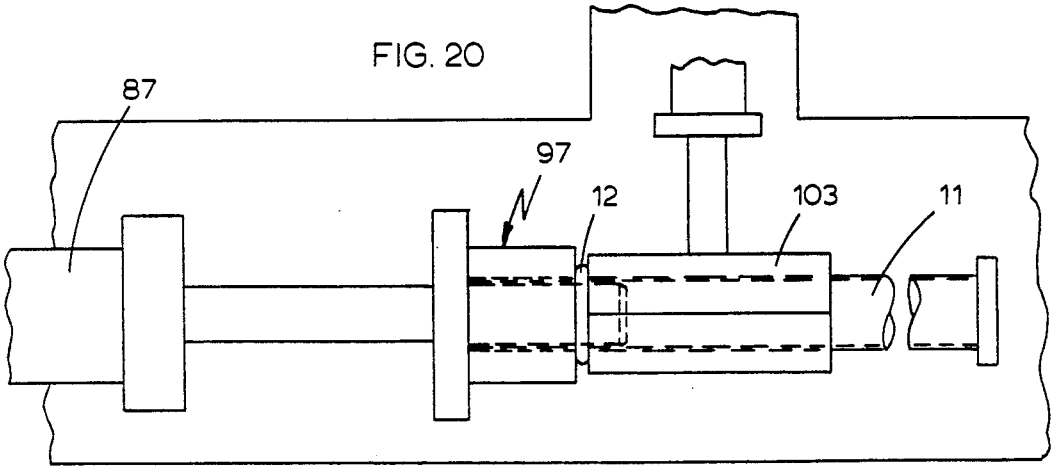
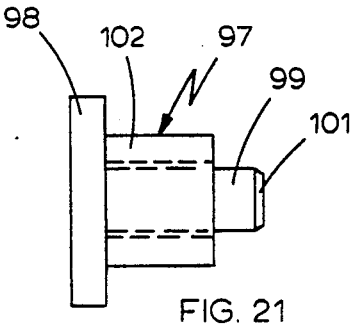
FIG. 21
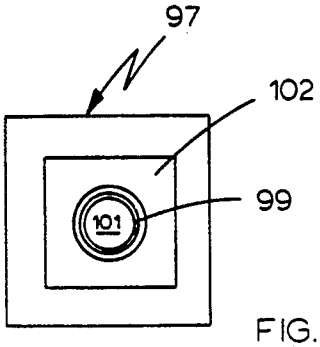
FIG. 22

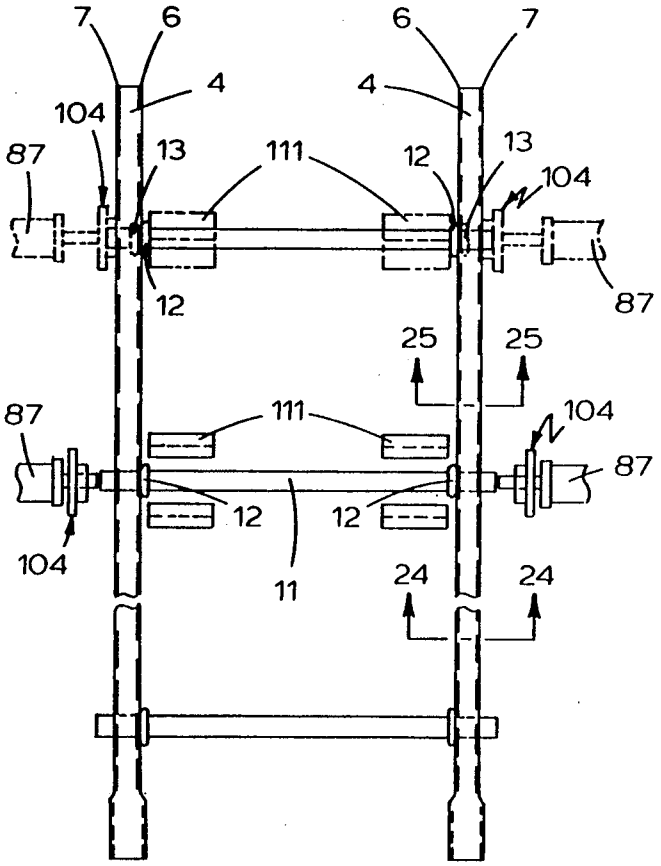
FIG. 23
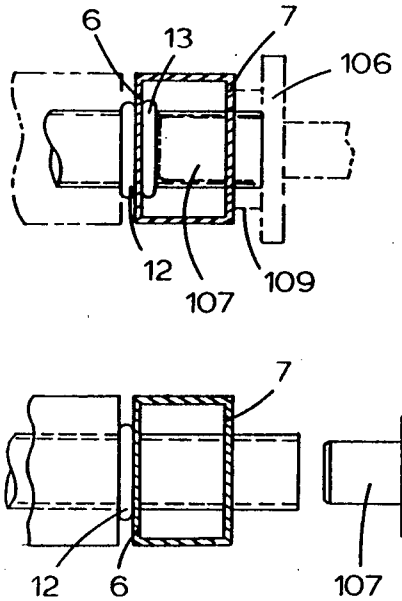
FIG. 24
FIG. 25
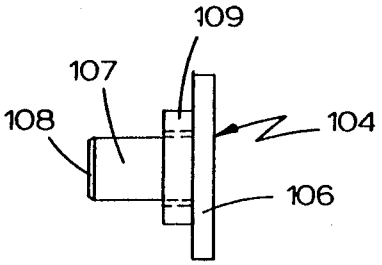
FIG. 26
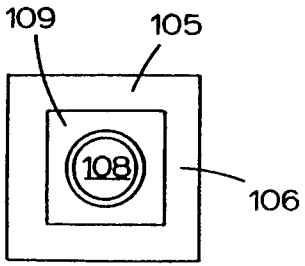
FIG. 27

METHOD OF MANUFACTURING A ROLLING TOWER SCAFFOLD

This is a divisional of copending application Ser. No. 07/413,694 filed on Sep. 28, 1989, now U.S. Pat. No. 5,069,309.

BACKGROUND OF THE INVENTION

The present invention relates to a climbing apparatus such as a rolling tower scaffold assembly and the method and tooling used in the manufacture and assembly of some of the several parts of the same. The present invention particularly includes unique features in the rung assembly, in the rail and caster assembly, in the scaffold platform and hand rail and carriage arrangement therefor, and in a novel tower stacking arrangement. In addition, the present invention includes a novel method for manufacturing the several parts of the tower assembly and the tooling therefor.

A large number of rolling tower assemblies are known in the art which include the general arrangement of spaced vertical ladders having an adjustable scaffold mounted therebetween, the ladders of the scaffold being mounted on casters at one end of the three or more vertical rails forming the scaffold uprights with such uprights being adaptable at the other end to stackingly engage with a second tower unit or module. Among the numerous patents known in the scaffolding art, attention is directed to expired U.S. Pat. No. 3,396,817, issued to E. D. Perry on Aug. 13, 1968, which teaches the general arrangement aforedescribed with a carriage for the scaffold platform having a spring urged, single pin latch means and to U.S. Pat. No. 3426867, issued to L. W. Berger on Feb. 11, 1969, which teaches the broad principle of sandwiching a pair of rung beads on either face of the web of a ladder rail of I-shaped cross-section. Although a number of other patents have been noted in the art which teach the above described general arrangement for a rolling tower scaffold, none teaches or suggests the many novel features of the present invention.

In accordance with the present invention, a straightforward and economical to manufacture and assemble rolling tower scaffold apparatus is provided which is durable, stable, and readily adjustable and adaptable to various heights and locations in a positive, lock-tight manner. In addition, the present invention provides a unique, rolling tower scaffold arrangement which can be readily assembled, adjusted and disassembled for both operational use and storage, the structure involved being comparatively light in weight, using only a minimum number of easily assembled parts to accomplish the many desired features. Further, the present invention provides a unique method for making several of the parts which are incorporated in the inventive structure and which can be employed in the manufacture of other climbing apparatus such as single or dual roll ladders. Even further, the present invention provides unique tooling which can be utilized in the forming of the several parts utilized in constructing the novel rolling tower scaffold apparatus.

Various other features of the present invention will become obvious to one skilled in the art upon reading the disclosure set forth herein.

BRIEF SUMMARY OF THE INVENTION

More particularly, the present invention provides a climbing apparatus in the form of a scaffold structure comprising: a pair of vertically extending spaced end ladders, each including a pair of spaced, opposed vertically extending rails having sets of spaced horizontally extending step forming rungs extending therebetween with the end portions of the rungs fastened to the opposed vertically extending rails, at least one of the end ladders having rails to each include spaced inner and outer rail walls joined by at least one intermediate wall in each of the opposed rails with the rung end portions of the end ladder rungs each having opposed radially extending spaced detents gripping the opposed faces of one of the opposed rail walls therebetween to firmly secure the rungs to the opposed rails, and a horizontally extending support platform supportively mounted between the spaced vertically extending end ladders. In addition the present invention provides for the rails to be of hollow tubular-like form with their sets of ends constructed to telescopically receive and arrest in nesting relation therewith a second set of rails of similar nature, one of which nesting sets has been expanded and crimped to accomplish the telescoping nesting engagement. In such arrangement, the nesting members can include a uniquely formed caster box set and/or the end set rails of a similar stacked tower. Further, the present invention provides a novel spring loaded device for snap-locking the nesting telescoping parts together in assembly to be firmly secured where desirable. Also, the present invention provides a novel adjustable height support platform and carriage which both resiliently snap-locks in adjusted position with multiple pin engagement in the rails of the rolling tower scaffold and which is further tightened in position by threaded screw assemblies. In addition, the present invention provides with the novel adjustable support platform, a socket arrangement for receiving a unique arrangement of a telescoping hand rail assembly including a uniquely formed pivotal gate and hinge at least at one ladder end thereof. Further, the present invention provides a novel method of forming a ladder which can be incorporated into the rolling tower including the steps of: forming at least one longitudinally extending rail to include spaced opposed first and second walls joined by an intermediate wall portion therebetween, the spaced opposed walls having a set of spaced, opposed aligned aperture pairs disposed therein; forming a set of hollow rungs, each having a cross-section at at least one end portion thereof sized to engage within a pair of spaced, opposed aligned apertures in the spaced, opposed first and second rail walls; forming a first detent in the end portions of each of the hollow rungs a preselected distance from the end extremity thereof in excess of the distance between the outer faces of the spaced first and second walls of the rail; inserting each of the hollow rungs of the set of rungs through one of the pairs of spaced, opposed aligned apertures in the first and second rail walls with the detents abutting the outer faces of one of the walls and the rung extremity extending through the other of the walls; and forming a second detent in each of the hollow rungs to abut the inner face of the wall abutted on the outer face thereof by the first detent thereby gripping at least one of the walls therebetween to fasten the rung in position. Even further, the present invention includes a novel method wherein part of the formation of the ladder rails, rungs and hand rails of the rolling tower scaffold can be accomplished with pressure flowable materials with the detents on the rungs and hand rails being formed through a novel series of method steps and novel tool structures designed to accomplish the same on such pressure flowable materials. Moreover, unique and novel tooling and method steps can be utilized to expand the pressure flowable rail end portions and to flare the pressure flowable rung extremities.

It is to be understood that various changes can be made by one skilled in the art in one or more of the several parts of the apparatus and tooling disclosed herein and in one or more of the several steps of the associated method also disclosed herein without departing from the scope or spirit of the present invention.

BRIEF DESCRIPTION OF THE DRAWINGS

Referring to the drawings which discloses one advantageous embodiment of the inventive rolling tower scaffold and the associated novel steps of the method and tooling utilized:

FIG. 14 is an enlarged side view of an expanded bottom portion of a rail, adapted to receive the caster box and caster wheel of FIG. 15.

FIG. 15 is an enlarged side view of a caster box of FIGS. 8 through 11 in with a caster wheel for insertion into the bottom portion of a rail such as in FIG. 14;

FIG. 16 is an enlarged side view of the top or upper portion of the rail of FIG. 14;

FIG. 17 is an enlarged side view of a hinge and a portion of the hand rail assembly of FIG. 2;

FIG. 18 is a cross-sectional view of the hinge and assembly of FIG. 17 taken in a plane through line 18—18 of FIG. 17;

FIG. 19 is a schematic plane view of an initial step in the method of forming a detent in the form of an annular bead in preselected spaced relation from one end portion of a ladder rung, and further disclosing the tooling used to accomplish the formation;

FIG. 20 is a view similar to that of FIG. 19 showing the formed annular bend;

FIG. 21 is a side view of a detent forming tool disclosed in FIGS. 19 and 20;

FIG. 22 is an end view of the tool of FIG. 21,

FIG. 23 is a side view of a portion of one of the ladders of the rolling tower assembly of FIGS. 1 and 2 illustrating a portion of the steps in carrying out the method of the invention with the inventive forming tools about to accomplish and accomplishing the forming of an annular bead on the inner faces of the inner rail walls with the first formed annular beads engaging against the outer faces of such inner walls;

FIG. 24 is an enlarged cross-sectional view of a portion of the ladder of FIG. 23 taken in a plane through line 24—24 of FIG. 23;

FIG. 25 is an enlarged cross-sectional view of a portion of the ladder of FIG. 23 taken in a plane through line 25—25 of FIG. 23;

FIG. 26 is a side view of the tool used in carrying out the method steps disclosed in FIG. 23;

FIG. 27 is an end view of the tool disclosed in FIG. 26;

DETAILED DESCRIPTION OF THE DRAWINGS

Figure 1:
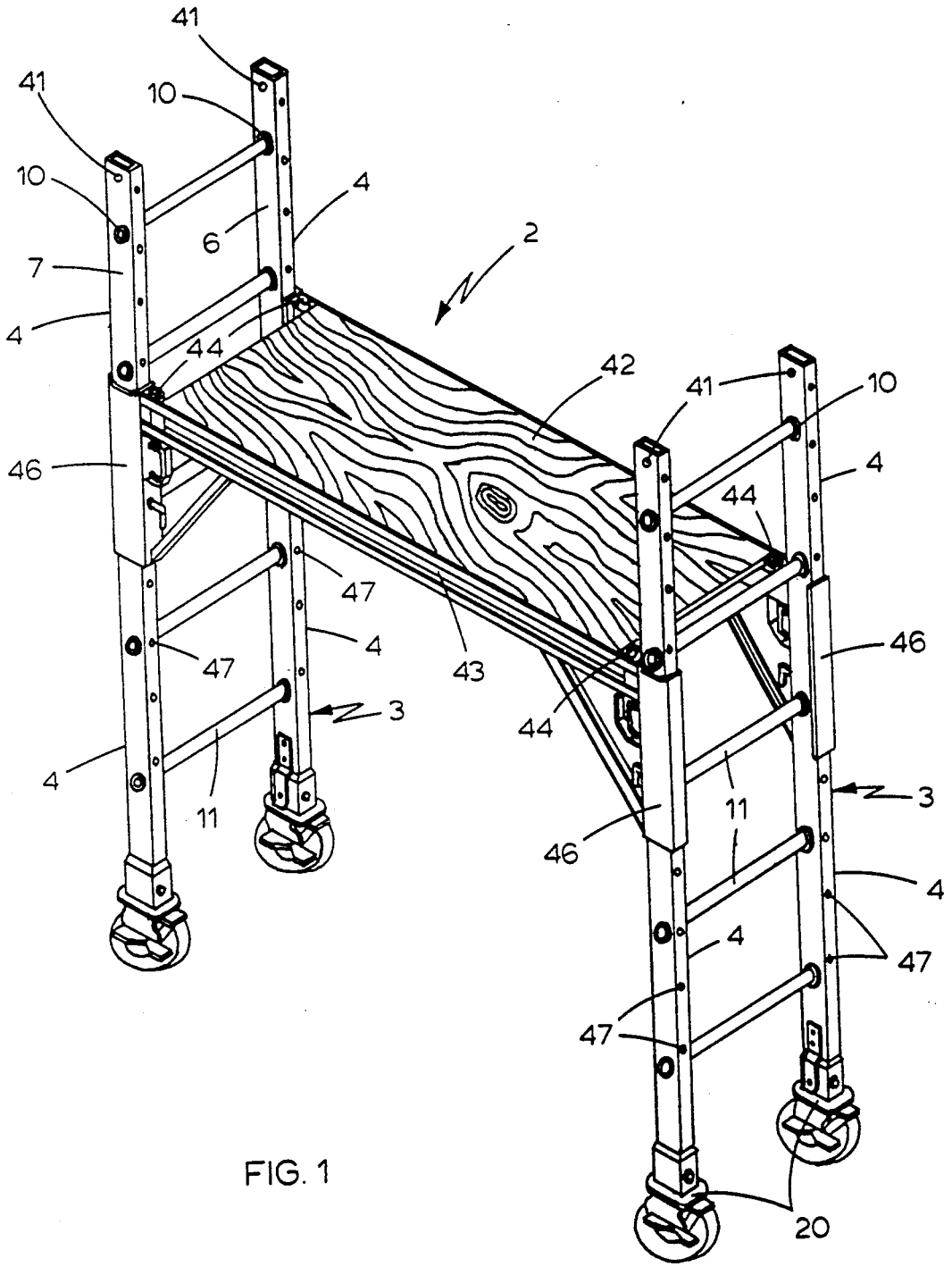
FIG. 1 is an isometric view of the overall inventive rolling tower scaffold assembly incorporating many of the numerous features of the present invention.
Figure 2:
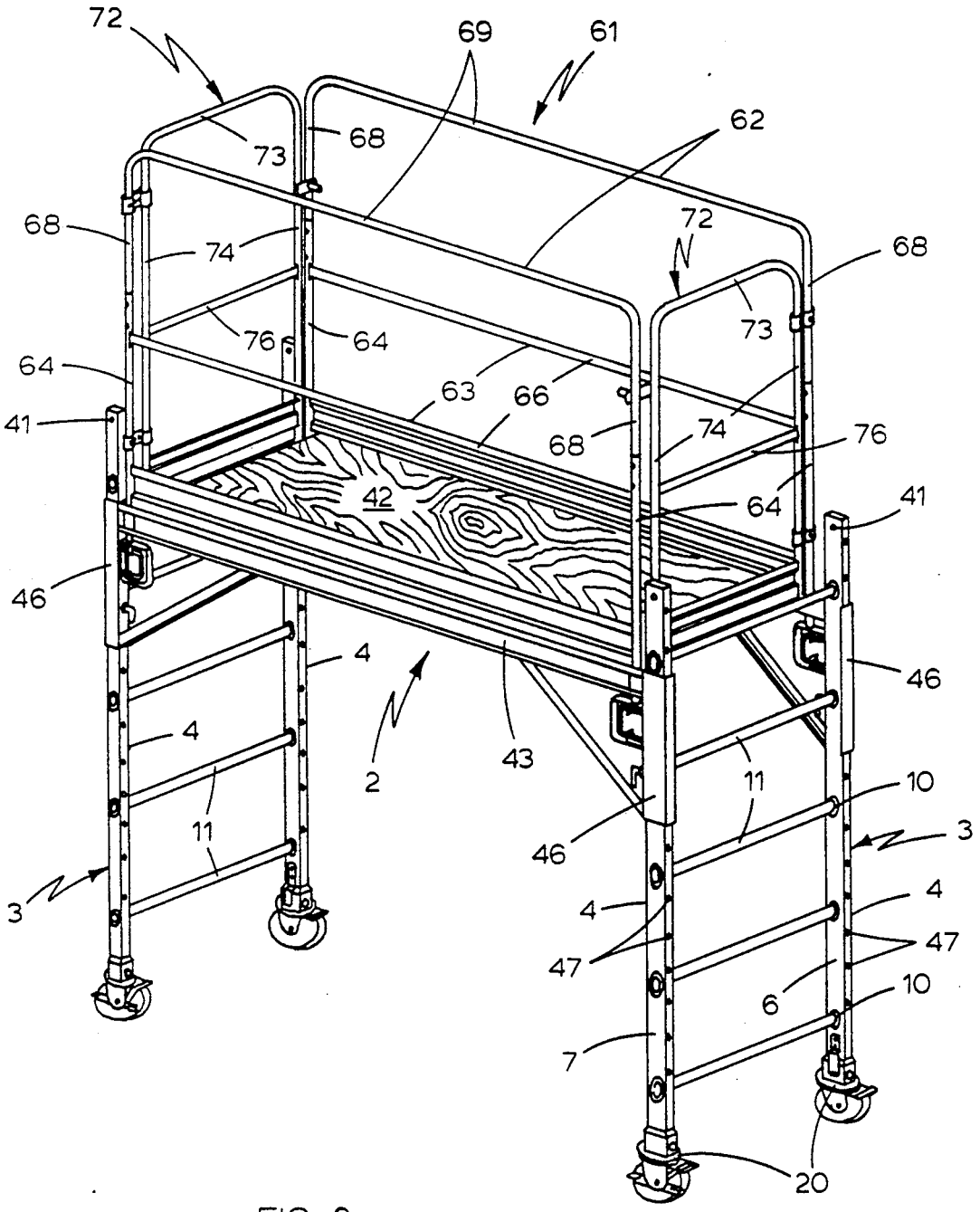
FIG. 2 is an isometric view of the rolling tower scaffold assembly of FIG. 1, further disclosing the inventive hand rail assembly associated therewith.

Referring to FIGS. 1 and 2 of the drawings, the inventive climbing apparatus is broadly disclosed in the form of a rolling tower scaffold assembly 2 including a pair of vertically spaced opposed end ladders 3. Each end ladder 3 includes a pair of spaced opposed vertically extend rails 4. As disclosed in the drawings, each of the ladder rails 4 is of hollow rectangular cross-section (FIGS. 3 and 4) to provide spaced inner and outer peripheral walls 6 and 7 respectively joined by spaced opposed intermediate walls 8 and 9 respectively. The ladder rails can be made from any one of several structurally sturdy and pressure formable materials such as a suitable gauge hot rolled steel.

It is to be understood, that although the ladder rails are disclosed as being of rectangular cross-section throughout, along their longitudinal axis, other tubular-like cross-sectional shapes could be used, such as a fully or partially enclosed cylindrical tube or even a U-shaped beam. Further, it is possible that only select portions of the rail could be provided with the aforedescribed cross-sections.

As can be seen in FIGS. 1-4 of the drawings, each end ladder 3 is provided with sets of spaced horizontally extending step forming ladder rungs 11 extending between each pair of spaced ladder rails 4. Rungs 11 can be formed from any one of a number of suitable pressure flowable materials such as a suitable gauge cold rolled steel. Like the steel rails 4, the ladder rungs 4 can be of hollow cylindrical cross-section or of some other different hollow cross-section, such as a "D" rung or an angular cross-sectioned rung such as a rectangular or triangular rung with the flat side of the rung serving as the step. Also like rail 4, the rungs 11 need not be hollow throughout but only along select portions thereof. It also is within the contemplation of the present invention to even utilize solid rungs throughout when the occasion might so require with appropriate structural and method adjustments being made as necessary.

As shown in the drawings, each ladder rung 11 is of hollow cylindrical tubular-like shape with a circular cross-section. Each rung 11 is provided at opposite end portions thereof with a pair of spaced detents in the form of spaced integral annular beads 12 and 13 extending radially outward from the outer peripheral surfaces of the end portions of each rung. It is to be understood that it would be possible to form other types of detents on the outer peripheral surfaces of the rungs. For example, it even would be possible to bore spaced aligned rungs and fasten detents therein or use one long rod extending through each row of aligned bores in the rung sets.

Figure 3:
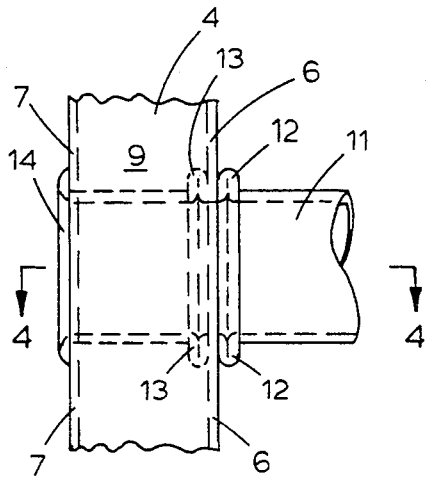
FIG. 3 is an enlarged side view of a portion of a rail member disclosing an end portion of a rung with a pair of detents thereon engaging the opposed faces of one of two walls joined by an intermediate wall of the rail portion and further disclosing the outer extremity of the end portion of the rung flared to engage the outer face of other wall of the rail portion.
Figure 4:
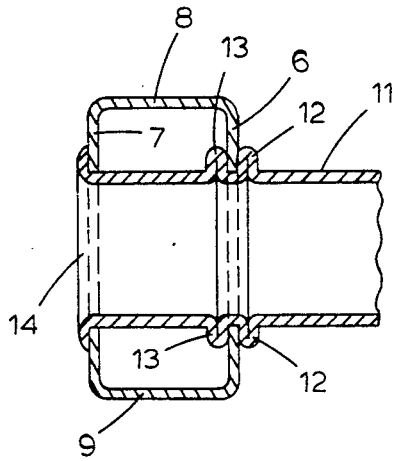
FIG. 4 is a cross-sectional view of the assembled rail portion and end rung portion of FIG. 3 taken in a plane through line 4—4 of FIG. 3.

As can particularly be seen in FIGS. 3 and 4 of the drawings spaced annular beads 12 and 13 on each ladder rung 11, which beads are spaced from the rung extremities, serve to grip therebetween the opposite faces of inner walls 6 of opposed ladder rails 4 of each end ladder 3. As also can be seen in these drawing FIGS. 3 and 4, the extremities of each of the end portions of a rung 11 are outwardly flared as at 14 to grip the outer faces of the outer walls 7 of opposed rails 4. With such a construction, the end portions of rungs 11 are firmly and tightly secured to the opposed rails 4 of each ladder in a manner heretofore unknown in the climbing art.

Figure 12:
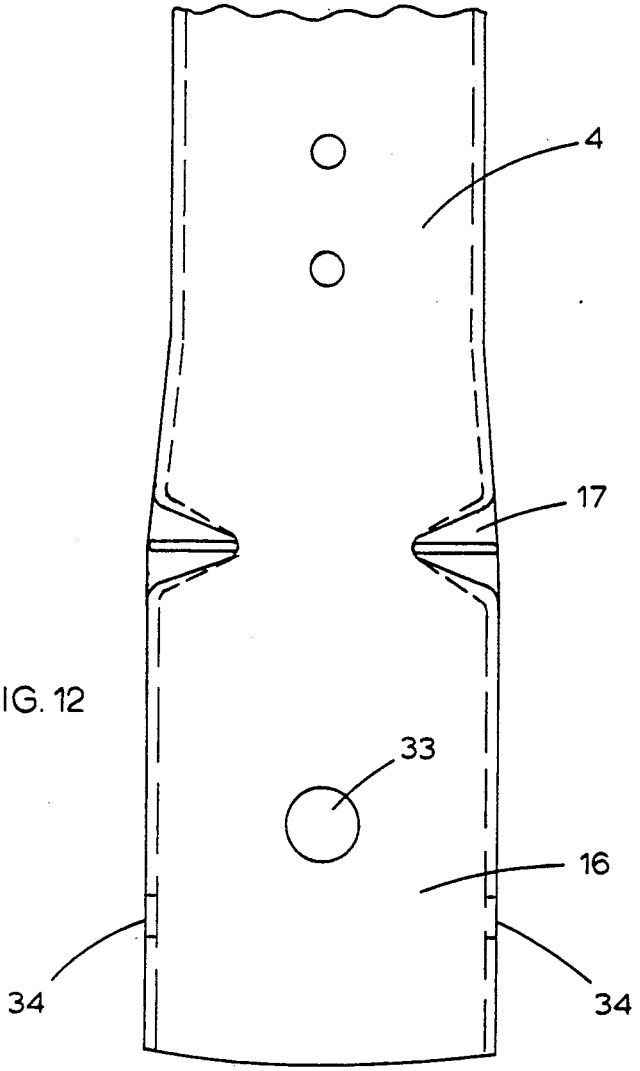
FIG. 12 is an enlarged side view of an expanded bottom portion of a rail of a stacking rail set like that disclosed in FIGS. 1 and 2.
Figure 13:
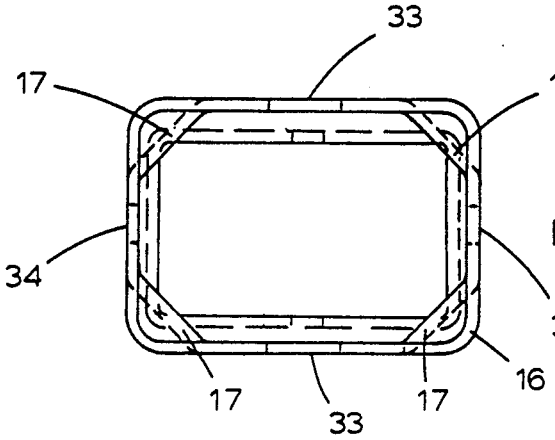
FIG. 13 is a bottom view of the rail of FIG. 12.

Referring to FIGS. 12 and 14 of the drawings, it can be seen that the bottom end portions of each hollow ladder rail 4 of opposed ladder rail pairs is larger than the main body portions of each rail, having been expanded a preselected distance from the extremity thereof and crimped as at 17 to telescopically receive a caster box 18 (FIGS. 8-11 and 15) snugly nesting therein. Each caster box 18 is one of a set of four, one for each rail 4 of the rolling tower scaffold assembly 2. Each caster box 18 itself is part of one of a set of caster box assemblies 19 for each rail 4 and includes a U-shaped caster wheel support bracket 21, the base of which is rotatably mounted through a suitable washer-stop 20, roller bearing construction 22 and connecting pin 23 passing through the bottom of caster box 18, the roller bearing 22 having one face mounted on the upper base of U-shaped bracket 21 and the other face to the bottom of the caster box by pin 23. The opposed downwardly extending legs of bracket 21 support the axle 24 for a caster wheel 26 provided with suitable locking or brake mechanism 27.

Figure 9:
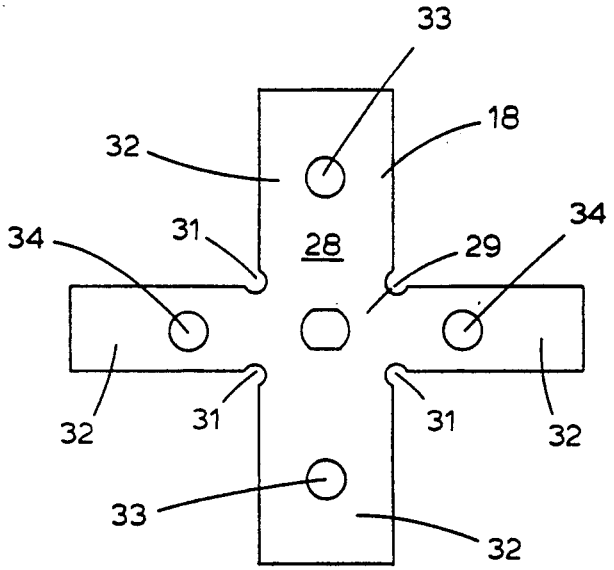
FIG. 9 is a plan view of a blank used in forming the caster box of FIG. 8.
Figure 11:
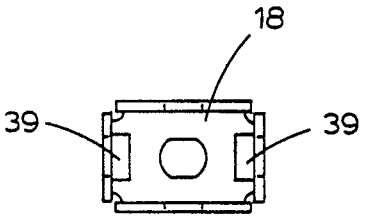
FIG. 11 is a top view of the caster box of FIG. 8.
Figure 8:
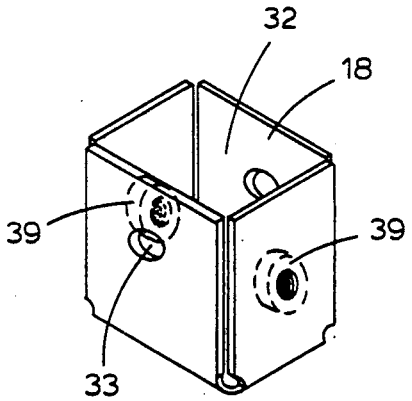
FIG. 8 is an enlarged isometric view of a novel caster box used in assembling a caster wheel to a rail of FIGS. 1 and 2.
Figure 10:
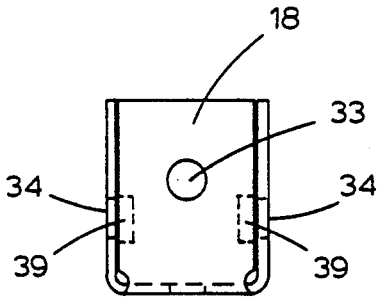
FIG. 10 is a side view of the caster box of FIG. 8.

As can be seen particularly in FIGS. 8-11, caster box 18 can be formed from an integral blank 28 of a suitable bendable material, such as steel (FIG. 9). Blank 28, which can be stamped, includes the aforementioned base or bottom 29 with relief cuts 31 and four sides 32 integrally extending therefrom and turned ninety degrees to extend in an upward direction to provide sides 32 of caster box 18. It is to be noted that each caster blank is so sized and geometrically shaped that each erected caster box 18 has a cross-sectional geometry corresponding with the cross-sectional geometry of the bottom end portions 16 (FIG. 14) of vertically extending ladder rails 4 to nestingly engage snugly therein in male-female relation. It also is to be noted that the inner and outer walls of each of the bottom rail portions 16 and the inner and outer walls of each of the caster boxes 18 have apertures 33 and 34 respectively therein. These apertures 33 and 34 are preselectively spaced on their respective parts to be aligned when each caster box 18 is inserted into snug nesting engagement with a bottom rail portion 16 with caster box 18 being arrested by washer-stop 20. As can be seen in FIG. 14, a resilient, spring-like arm 36, made of a suitable flexible thin gauge material, such as steel is mountedly fastened to each inner wall of each ladder rail 4 by suitable rivets 37 to extend downwardly in resilient cantilever fashion over the aligned apertures 33 in the rail and caster box. This arm is provided with a suitable detent 38 which engages in aligned apertures 33 to snap-lock box 18 to bottom rail portion 16. Each caster box 18 is further provided with opposed threaded nuts 39 centered internally on those apertures 34 in the opposed walls on either side of and below the aperture 33 on the inner wall receiving detent 38. These nuts serve to receive threaded bolts therethrough when apertures 34 are aligned to threadedly and securely lock the respective parts together.

As can be seen in FIG. 16, the top portion of each rail 4 has a plurality of apertures 41 in the walls thereof positioned and spaced therein in a manner similar to the apertures 33 in the bottom rail portion of a rail 4 of another set of rails (FIG. 12) so that rails of one set telescopically and snugly nest with aperture 33 in such expanded bottom rail portion 16 of another set to permit the stacking at the top of assembly 2 of another similar assembly.

Figure 7:
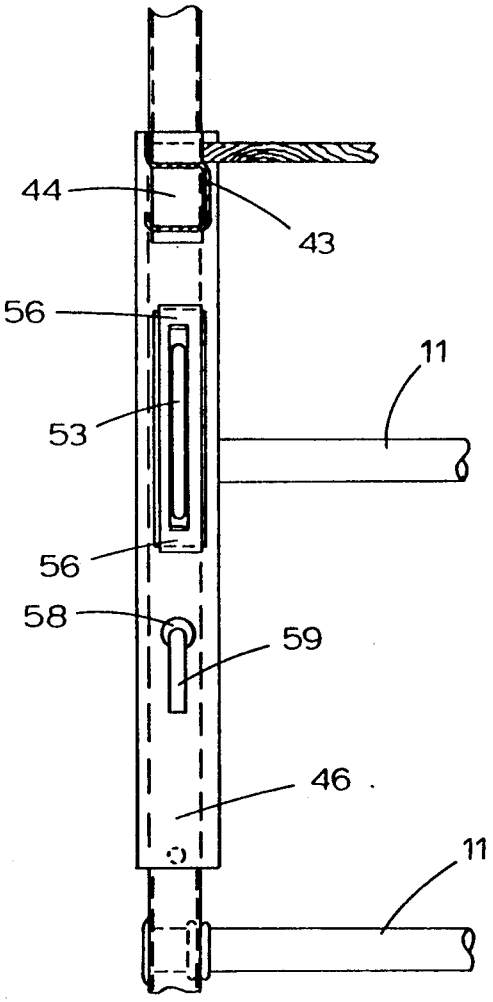
FIG. 7 is an end view of the rail and carriage portion of FIG. 6.
Figure 6:
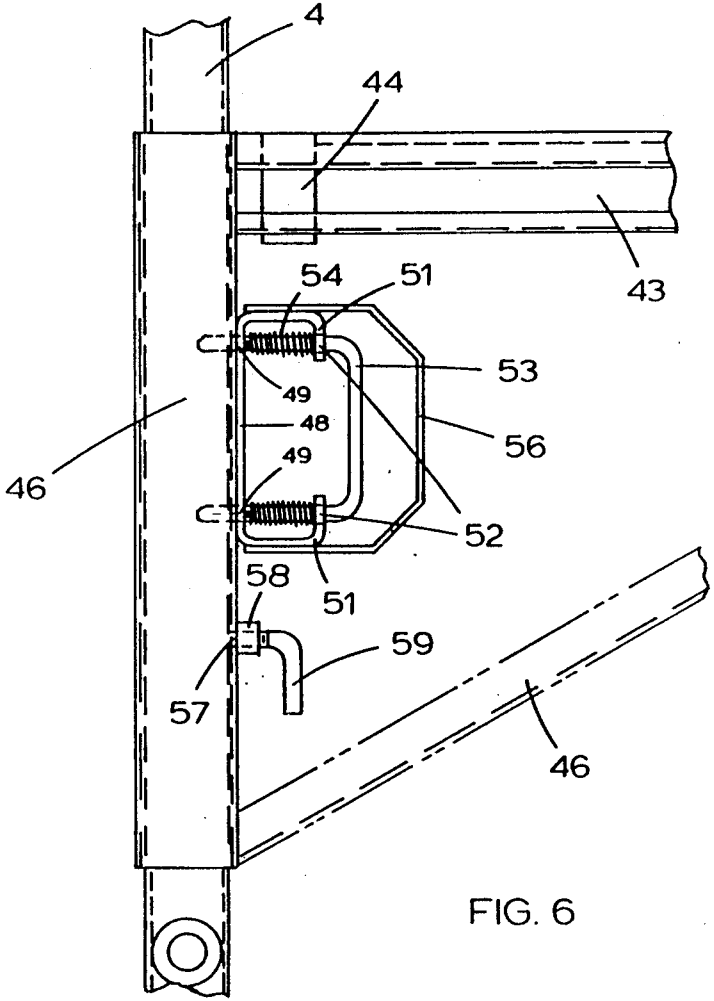
FIG. 6 is a side view of a portion of a rail carriage for a scaffold platform disclosing one latching and tightening assembly for latching and tightening the slidable carriage to a rail.

As can be particularly seen in FIGS. 1 and 2, rolling tower scaffold assembly 2, includes a horizontally extending support platform in the form of a rectangular sheet of high strength support material which can be either of wood or an appropriate insulated metal or hard composition. Support platform 42 is adjustably mounted between the opposed spaced, vertically extending end ladders 3. A rectangular frame member 43, which can be of a suitable material—such as steel, supports platform 42 and can be fastened thereto by some appropriate means if desired and/or appropriately sized to rest snugly on the ledge of the frame with the corner pairs of platform 42 snugly abutting between the two opposed pairs of open ended tubular sockets 44 (FIG. 1) fixed to frame member 43 and described hereinafter. Also fixed to the frame member 43 with suitable truss members are two pairs of carriage rails 46. Each carriage rail 46, which can be U-shaped in cross-section and of a suitable sturdy steel material extends vertically downward from frame 43 and is appropriately sized to slidably engage with one of the four vertically extending rails 4 of the two opposed end ladders 3. Each rail 4 is provided with a plurality of spaced aligned latching apertures 47 extending down one side or inner wall thereof. As can be seen more fully in FIGS. 6 and 7, each carriage rail 46 has fixed thereto a first U-shaped member 48 having its base portion, or base leg, extending longitudinally along and fixed to carriage rail 46 by some suitable means such as welding. This base portion is provided with a pair of apertures 49 (FIG. 6) therein which extend through aligned apertures in the carriage wall and are in the same spaced relation as the latching apertures 47 in rail 4 to be aligned therewith. The spaced opposed legs of U-shaped member 48 extend at right angles to the base portion thereof and are inwardly turned at right angles at the end portions 51 with apertures 52 therein aligned with the apertures 49 in the base portion to accommodate a second moveable U-shaped member 53 with its base portion or base leg spaced from the base portion or base leg of U-shaped member 48 and its spaced legs extending through the aligned apertures to serve as a pair of simultaneously engageable and releasable locking pins cooperating with the spaced, aligned apertures 49, carriage apertures and latching apertures 47 in the inner wall of a vertically extending ladder rail 4. With this arrangement the pins or legs of moveable U-shaped member are firmly aligned with the spaced apertures 47 on rail 4 to provide a positive double latching engagement therewith. It is to be noted that the pins or legs of member 47 extend through a pair of helically coiled springs 54 which extend between the inturned leg portion of member 48 and the base thereof. The extremities of springs 54 adjacent the base are fixed to the pins to allow resilient compression of the springs 54 when moveable U-shaped member 53 is disengaged from the aligned apertures in the rail to be spring urged for return aperture engagement. A third U-shaped guard and fixed handle gripping member 56 is provided with its opposed legs fixed to the legs of U-shaped member 48 by some suitable means such as welding and the base portion or base leg thereof extending parallel and spaced from the base portion or base leg of moveable U-shaped member 53. It is to be noted that the aforedescribed U-shaped members are so sized as to allow a finger squeezable gripping relation therebetween in the manner of an easily manipulated, pistol-like grip. It further is to be noted that each carriage member 46 is provided with a further spaced aperture 57 below apertures 49 which is spaced to be out of alignment with the spacing of latching apertures 47, apertures 57 receiving a tightening device to absorb any play of the carriage on the rail. A nut 58 is fastened to the wall of carriage rail 46 in alignment with aperture 57 to receive the threaded leg of L-shaped lock 59 for further positive tightening engagement of the carriage 46 to rail 4.

Figure 5:
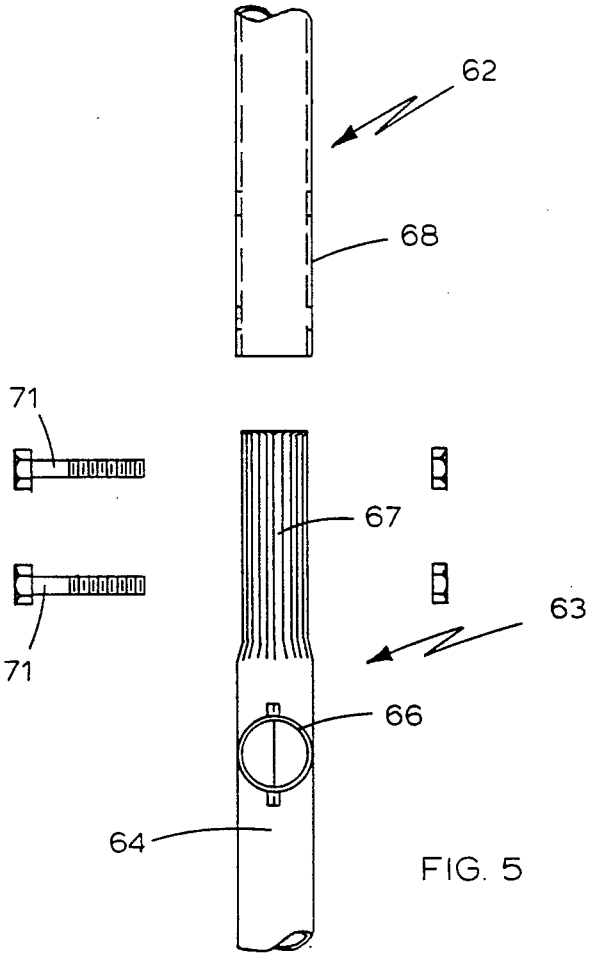
FIG. 5 is an exploded, enlarged side view of end leg portions of the upper and lower sections of a side hand rail adapted to nestingly engage.

Referring again to FIGS. 1 and 2 and to FIG. 5, the aforedescribed socket members 44 mounted at the four corners of rectangular frame 43 are adapted to receive in nesting relation therewith a hand rail assmebly 61. Hand rail assembly 61 includes pairs of upper and lower side hand rail sections 62 and 63 respectively (FIG. 2). The pair of lower hand rail sections 62 comprises two longitudinally extending spaced H-shaped frame members, each having two spaced apart vertically extending end legs 64 and at least one horizontal connecting bar 66 extending therebetween and connected at its opposed ends to said legs. The end legs 64 in the lower rail section 63 are sized at their bottoms to snugly nest in sockets 44. The upper ends of vertical hand rail legs 64 are narrowed, as at 67, to telescopically and nestingly receive in snug engagement therewith the downwardly extending legs 68 of upper rail sections 62 (FIG. 5). In this regard it is to be noted that these downwardly extending legs 68 are part of two U-shaped spaced upper rail sections 62 with the horizontally extending base legs 69 serving as the upper side hand rails. Suitable alignable apertures can be provided in the nesting leg portions 67 and 68 of the upper and lower sections to receive threaded nuts and bolt assemblies 71 to secure the sections together.

As can be seen in FIG. 2 of the drawings, a pair of spaced gate members 72 are pivotally mounted at the opposed ends of the hand rail assembly 6 adjacently above the upper ends of the opposed end ladders 3. Each gate member 72 includes a U-shaped frame with the base leg 73 serving as the upper end hand rail bar and the downwardly extending spaced vertical legs 74, extending adjacent legs 64, 68, being joined by at least one intermediate horizontally extending cross bar 76 extending between and connected at its ends to spaced downwardly extending spaced vertical legs 74. It is to be noted that one of the downwardly extending legs 74 to each gate member 72 is pivotally mounted to adjacent nesting legs 68, 64 of the upper and lower hand rail sections 62 and 63 respectively. Referring particularly to FIGS. 17 and 18 of the drawings, the detailed apparatus for accomplishing such pivotal movement is disclosed to include spaced pairs of spaced radially extending detents which can be formed in the pivoted downwardly extending leg 74 by a novel method described hereinafter. These pair of spaced detents of each pair are shown in the form of radially extending spaced annular crimps 77 (only one such pair of crimps being shown) extending around leg 74. A pair of hinge assemblies 78 serve to cooperate with spaced detent annular beaded crimps 77 to pivotally connect the adjacent downwardly extending legs 74 to adjacent nesting legs 68 and 64. In this regard, each hinge assembly 78 includes a pair of mirror-image strap members 79 having suitably U-shaped or semi-circular end portions which are sized when joined and fastened in mirror-image relation by threaded nut and bolt assemblies 81 passing through facing intermediate sections to extend around adjacent vertically extending rail 74 and one of nesting rails 64, 68. The mating strap ends extending around rail 74 allow the rail to pivot therein with the straps being retained in position by spaced detent crimps 77. The opposite mating strap ends extending around one of nesting rails 64, 68 are fastened to the rail by a bolt and nut assembly 82 passing through aligned apertures in the strap ends and the rail member surrounded thereby.

To form the abovedescribed novel apparatus a number of novel manufacturing method steps and tools are associated therewith including: the method steps and tools for manufacture of the end ladder rail bottom and the method and tools for manufacture of the end rungs associated with the end ladder rails and parts of the hand rail assemblies associated with the aforedescribed support platform.

Figure 32:
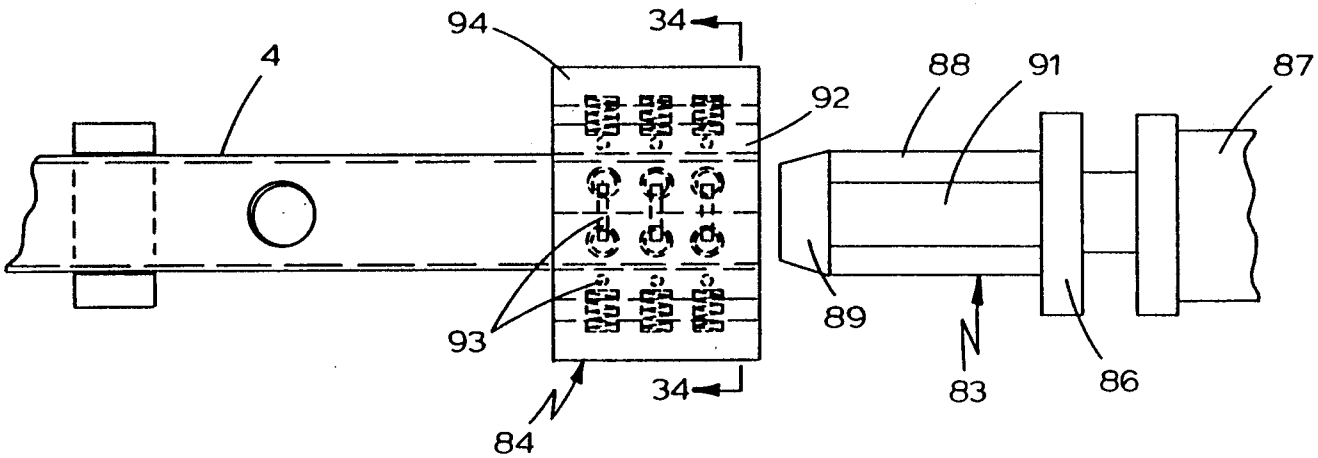
FIG. 32 is an enlarged exploded side view of a bottom end portion of a rail of FIGS. 1 and 2 similar to the rail end portions of FIGS. 12 and 14 illustrating still another of the steps in carrying out the method of the invention with the inventive forming tool about to accomplish the expansion of the bottom portion of the rail.
Figure 33:
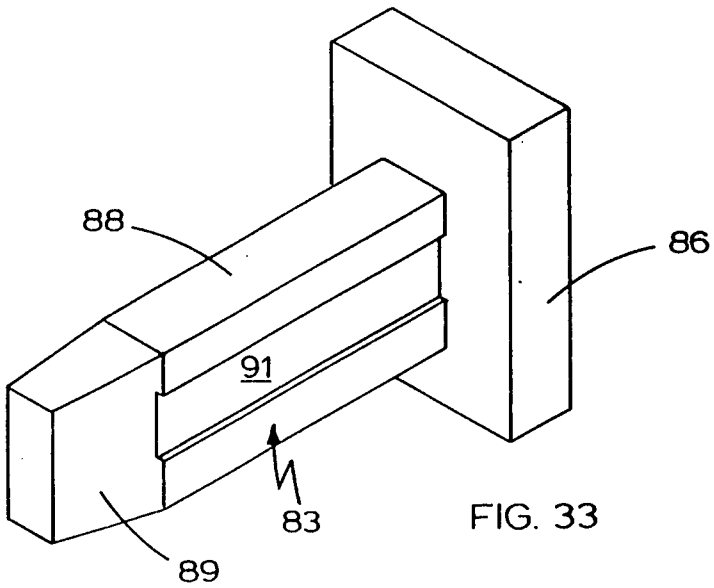
FIG. 33 is a further enlarged isometric view of the male die tool used in carrying out the illustrated method step of FIG. 32.
Figure 34:
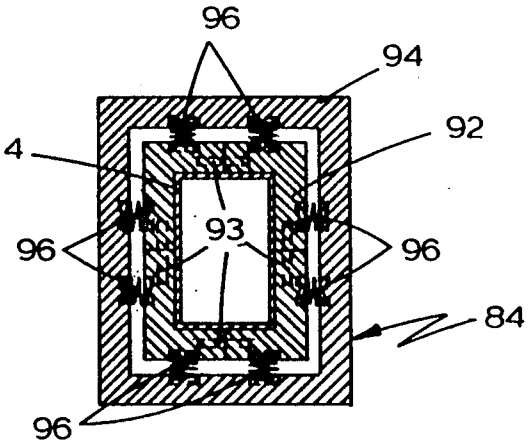
FIG. 34 is a cross-sectional view of the female die tool which can be used in carrying out the illustrated method step of FIG. 32, taken in a plane through line 34—34 of FIG. 32.
Figure 38:
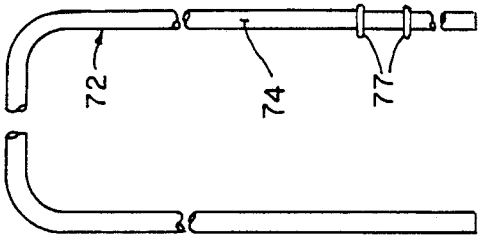
FIG. 38 is a portion of a side rail incorporating spaced annular bead detents formed by the method steps illustrated in FIGS. 35 and 36, the spaced detents serving to receive corresponding mirror image ends of the embracing hinge straps of a hinge as shown in FIGS. 17 and 18.

Specifically, to form the aforedescribed rolling tower scaffold assembly 2 the two pairs of elongated, longitudinally extending hollow end ladder rails 4 of rectangular cross-section for end ladders 3 are formed from a pressure flowable material, such as a strong hot rolled steel to each include opposed inner rail wall 6 and outer rail wall 7 integrally joined by the opposed intermediate walls 8 and 9. The inner and outer walls 6 and 7 of each rail is formed, such as by punching, to include a plurality of spaced, aligned preselectively positioned and sized rung receiving apertures 10 therein and each rail further includes a plurality of preselectively positioned and sized latching apertures therein to align with latching apertures on parts to be assembled thereto including caster box 18 (FIGS. 8–11 and 15) of a caster wheel and box assembly (FIG. 15), a detent 38 of a resilient cantilevering latching arm 36, a slidable carriage rail 46 of support platform and frame assembly 42 and 43, and a bottom rail of another similar assembly 41 (FIG. 16) As can be seen in FIGS. 12 and 14, each of the bottom of rail 4 is then expanded a preselective distance from the extremity of the rail to provide bottom end portion 16. This is accomplished with a pair of mating male and female dies 83 and 84 (FIGS. 32–34). Male mandrel die 83 includes an anvil plate 86 which can be pressure urged by a suitably powered cylinder and piston drive assembly 87. Mounted to anvil plate 86 is the male mandrel die which includes a main body portion 88 with an outer peripheral surface shaped to conform with the shape of the inner peripheral surface of the end bottom portion of hollow rail 4 after expansion, thus being of a preselected larger size than the inner peripheral surface of rail 4 before expansion. Male mandrel die 83 (FIGS. 32 and 33) further includes a tapered lead end portion 89 integral with and tapering inwardly toward the extremity from the main body portion 88 with the end extremity of lead end portion 89 being sized and shaped to nestingly conform with the inner peripheral surface of the end portion of hollow rail 4 which is to be expanded when the male lead end portion 89 of male mandrel die 83 is first inserted under pressure to the anvil 86 of the male member. It is to be noted that the main body portion 88 of male die 83 is further provided with a longitudinally extending relief channel 91 to reduce frictional drag as the male die 88 is pressure urged forwardly to expand the bottom portion of rail 4.

As can be seen in FIGS. 32 and 34, female die 84 provides a resiliently yieldable and flow limiting female sleeve assembly cooperably with male mandrel die 83. Female die 84 includes an expansible rectangularly shaped hollow split inner sleeve 92 having an inner peripheral surface sized, shaped and adapted to initially surround and engage the outer peripheral surface of the end portion of the hollow rail member 4 to be nested therein. This split inner sleeve 92 includes the linking guide pins 93 which serve to guide the movement of the split parts of the sleeve as the sleeve expands outwardly. A surrounding hollow integrally fixed rectangularly shaped outer sleeve 94 having an inner peripheral surface preselectively spaced from the outer surface of expansible hollow split inner sleeve 92 serves to limit the outward expansion thereof during expansion of the rail end portion. Suitable helically coiled springs 96 are provided between the inner and outer sleeves 92 and 94 respectively to yieldably hold split inner sleeve 92 in yieldable engagement with the end portion of the hollow rail as it is expanded. It, of course, is to be understood that this tool, including male and female dies 83 and 84, can be appropriately shaped in accordance with the shape of the hollow rail or tube to be expanded.

Once dies 83 and 84 have pressure flowed the material of the end or bottom portions of each rail 4 to expanded position, each expanded section is crimped for possible stacking with a suitable crimping tool (not shown) as at 17 (FIGS. 12 and 14), the crimp being a preselective distance from the bottom extremity of each rail 4 and the expanded portion serving to receive in nesting telescoping relation thereith one of the caster boxes 18 of caster box and wheel assembly 19 (FIGS. 14 and 15). To hold the boxes in inserted position, one end of a cantilevering resilient leaf spring member 36 (FIG. 14) is fastened on the bottom end of rail 4 by rivets 37, the leaf spring member 36 having a detent 38 preselectively positioned thereon to engage in aligned latching apertures 33 in the expanded bottom portion 16 of rail 4 and a caster box 18 nested therein.

Each of the sets of ladder rungs 11 are formed from a pressure flowable material so that each rung includes hollow end portions sized to engage in the spaced, aligned rung receiving apertures 10 in the inner and outer walls 6 and 7 of each rail 4. In the present disclosure, the rungs 11 are formed from a suitable pressure flowable material such as cold rolled steel to be of tubular cylindrical shape with circular cross-sections. It is to be understood that other shaped rungs can be formed, such as ones with "D" shaped or triangular cross-sections. Detents in the form of radially extending annular beads 12 are then formed on the end portions of each formed rung 11 (FIGS. 19–22) with a rung tool 97 which pressure flows the surface of the end portions of rungs 11 to a preselected distance from the end portion extremities to form annular beads 12 radially extending outwardly from the outer peripheries of the hollow end portions of rungs 11. The formed annular beads 12 are positioned to abut the inner faces of the inner walls 6 of rails 4, allowing the end portions of the rungs 11 to extend a preselected distance through both inner wall 6 and outer wall 7. To accomplish this formation of the annular bead detents 12 on rungs 11, tool 97 (FIG. 21) includes an anvil plate 98 having a mandrel 99 in the form of a solid cylindrical tube fixed to and extending normally from one face of plate 98. The outer extremity of mandrel 99 is tapered inwardly toward the extremity for entrance into the end portions of rungs 11. Mandrel 99 is so sized that its outer peripheral surface conforms with the inner surface of the end portions of rungs 11. The mandrel 99 is of sufficient preselected length to at least extend in proximity with the location of the furthermost detent to be formed from the end extremity of a rung 11 to be worked. In the instance of forming beads 12, the length of mandrel 99 is sufficient to locate the bead 12 on the end portions of a rung 11 to allow the bead to abut against the outer face of inner wall 6 (FIG. 3) with the remainder of the rung end portion extending through inner wall 6 and outer wall 7. As will be seen hereinafter, in the situation of forming beads 13 on the inner face of inner wall 6, the length of mandrel 107 (FIG. 24) is sufficient to locate the bead 13 on the end portions of a rung 11 to allow the bead 13 to abut against the inner face of inner wall 6 (FIG. 3) to grip the inner wall 6 between the detent annular beads 12 and 13 and hold the rung end portion fast to rail 4. As can be seen in FIGS. 19–22 illustrating the formation of annular detent beads 12 and the tool therefor and in FIGS. 23–26, illustrating the formation of annular detent beads 13 and the tool therefor both tools can be pressure urged by a suitable piston and drive assembly 87, such as that used for male die anvil plate 86 in FIG. 32 to move the full length of the mandrel 99 into snug nesting engagement with the end portion of rung 11. As can be seen in FIG. 21, tool 97 includes a sleeve 102 fixed to and extending normally from anvil plate 98 in spaced surrounding relation to mandrel 99 to allow the end portion of a hollow rung 11 to snugly engage therein between mandrel 99 and the inner peripheral hollowed surface of sleeve 102. The sleeve has a preselected length sufficient to aid in the formation of the detent. Referring to FIGS. 19 and 20 successively, the steps of forming annular beads 12 are illustrated, including clamping rung 11 with a suitable power driven vise or clamp 103 adjacent the preselected end portion thereof, inserting mandrel 99 into the extremity of the end portion of rung 11 to extend approximately the preselected distance thereof with anvil plate 98 abutting the end extremity of rung 11 and sleeve 102 surrounding the outer periphery of the rung end portion. The movement of the piston of drive assembly 87 causes the peripheral pressure flowable material of rung 11 surrounded by sleeve 102 to move in wave-like form to collect as an annular bead 12 against the wall of vise or clamping device 103.

Once annular beads 12 are formed on the end portions of rungs 11, each set of rungs 11 are assembled to opposed rail pairs 4 with the detents 12 formed on the end portions of rungs 11 abutting the outer faces of the opposed inner walls 6 of rails 4 and with the remaining end portions of rungs 11 extending through inner wall 6 and outer wall 7 of rail 4.

With this accomplished, detents 13 are then formed on the rung end portions along the inner faces of opposed inner wall 6 with a tool 104 (FIG. 26) similar to that of tool 97 but with differences in mandrel and sleeve length to pressure flow the surface of the end portions of the rungs 11 to form detents 13 adjacent the inner faces of inner walls 6 with detents 12 and 13 firmly gripping inner wall 6 therebetween.

Referring to FIGS. 23–26 of the drawings and particularly FIG. 26, it can be seen that tool 104, like tool 97 of FIGS. 21 and 22 is provided with an anvil plate 106 having fixed to and extending normally from one face thereof a solid cylindrical mandrel 107 with an inwardly tapered end portion 108. The cross-sectional size and outer peripheral surface of mandrel 107 is like mandrel 96 to allow it to engage in snug nesting relation with an end portion of rung 11; however the length of mandrel 107 is electively less than mandrel 99 and is sufficient to allow it to extend through outer wall 7 of rail 4 and terminate in a location adjacent the inner face of inner wall 6 of rail 4. A sleeve 109, similar to sleeve 102 of tool 97, is fixed to and extends normally from anvil plate 106 in spaced surrounding relation to mandrel 107 to allow the end portion of a hollow rung 11 to snugly engage therein between mandrel 107 and sleeve 109. This sleeve 109 is shorter in length than sleeve 102 of tool 97, to permit the mandrel 107 to extend to the inner face of the inner wall 6 of rail 4 and control the amount of material to be flared. As can be seen in FIGS. 23 through 25, the steps of forming bead 13 is somewhat similar to the steps of forming bead 12, the shortened sleeve and longer mandrel of tool 104 enhancing the formation of bead 13 in the different location on the end portions of rung 11. The rungs 11 are clamped with a suitable power driven vise or clamp adjacent beads 12, mandrel 107 is inserted into the extremity of the end portion of rung 11 to extend approximately the preselected distance thereof with sleeve 109 abutting the end face of outer rail 7 and surrounding only a portion of the outer periphery of the rung 11 end portion. The movement of the piston of drive assembly 87 causes the peripheral pressure flowable material of rung 11 surrounded by sleeve 109 to move in wave-like form to collect as an annular bead 13 against the inner face of inner wall 6 of rail 4 with spaced detent beads 12 and 13 formed on the rung end portion gripping the inner wall 6 of rail 4 firmly therebetween.

It is to be understood that it would be possible under certain conditions to use one tool to accomplish the formation of annular detents 12 and 13 with the mandrel and sleeve being sized in accordance with existing conditions. It also is to be understood that various power drive assemblies can be used to drive the several anvils disclosed hereinbefore and hereinafter.

Once rungs 11 have been assembled to rails 4 with detents 12 and 13 gripping inner walls 6, the outer extremities of the end portions of rungs 11 extending through outer walls 7 are flared with a tool to pressure flow the material to provide flared detents to grip the outer faces of outer walls 7.

Figure 29:
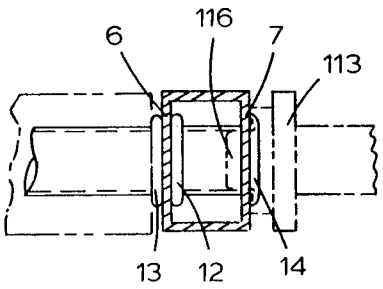
FIG. 29 is an enlarged cross-sectional view of a portion of the ladder of FIG. 28 taken in a plane through line 29—29 of FIG. 28.
Figure 30:
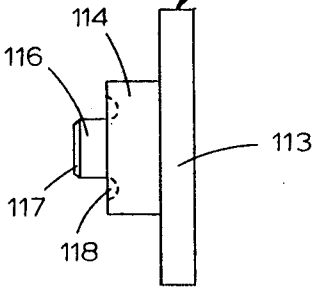
FIG. 30 is a side view of the tool used in carrying out the method steps disclosed in FIG. 28.
Figure 31:
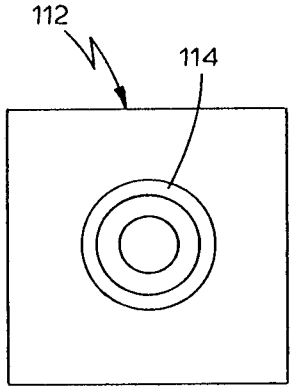
FIG. 31 is an end view of the tool disclosed in FIG. 30.
Figure 28:
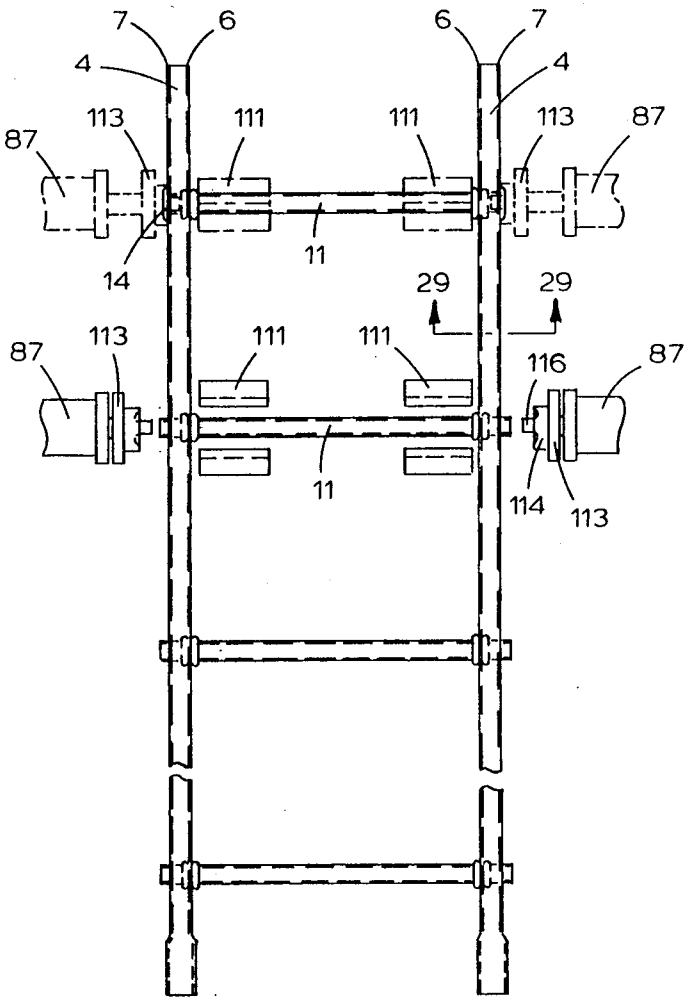
FIG. 28 is a side view of a portion of one of the ladders of the rolling tower assembly of FIGS. 1 and 2 illustrating another portion of the steps in carrying out the method of the invention with the inventive forming tools about to accomplish and accomplishing the flaring of the extremities of the end portions of the rungs.

Referring to FIGS. 28–30 of the drawings and particularly FIGS. 31 and 30, the tool 112 to accomplish such rung extremity flaring is disclosed. This tool 112 includes an anvil plate 113 having a forming die 114 fixed to and extending normally from one face thereof. A centering and guide mandrel 116 is fixed to and extends normally from forming die 114 and in the drawings, die and mandrel are shown as an integral unit. An inwardly tapered end portion is provided at the extremity of mandrel 116. The peripheral surface of the mandrel is shaped to nest in snug engagement with the end extremity of the end portions of rungs 11 to be flared. Forming die 114 includes a recessed well 118 adjacent the base of centering mandrel 116 to receive the flowing material of the rung extremity end portion when the centering mandrel 116 is urged into engagement with the extremity of the end portion of rung 11 to flare the rung against the outer face of outside wall 7. As can be seen in FIGS. 28 and 29 forming die 114 with its centering mandrel 116 is positioned to engage the extremities of the end portions of rungs 11 extending through outside wall 7. As the mandrel and forming die are urged forwardly against the protruding extremities of the rung end portions the pressure flowable material of each rung collects in well 118 and is caused to flare against the outer face of outside wall 7.

Once the rungs 11 have been assembled to rails 4 in the manner abovedescribed, the caster box assembly 19 including caster box are ready to be inserted into the abovedescribed expanded bottom end portions 16 of rails 4. The caster boxes 18 (FIGS. 8–10) can be punch formed from a suitable bendable integral blank material 28, such as steel, (FIG. 9) to include an aperture bottom 29 and punched latching apertured caster box sides 32 which are turned at right angles to form caster box 18 sized to nest with the expanded and crimped bottom portion 16 of each rail 4 with the apertured bottom portion 29 of box 18 having pin 23 (FIG. 15) extending therethrough through washer-stop 20 and roller bearing construction 22 sandwiched between the bottom portion 29 and the caster wheel support to which pin 23 is connected. The caster boxes 18 and connected caster wheel assemblies are then inserted into the expanded and crimped bottom portions of each rail 4 to snugly nest therein so that the detent 38 of cantilevered resilient arm 36 engages in aligned latching apertures in caster box 18 and bottom portion 16 of rail 4 and so that other locking apertures 34 in the rail bottom portion 16 and caster box 18 are aligned to receive threaded locking bolts 40.

Rectangular frame member 43 is formed to include slidable carriage rails 46 therebelow and open end side hand rail sockets 44 at each end corner thereof, the carriage rails 46 having pairs of spring urged latching pins of moveable U-shaped element 53, are then mounted on and between spaced end ladders 3 with the slidable rail carriages 46 engaging rails 4 and the pins of element 53 on the carriages 46 adjustably engaging in the latching apertures 47 on rails 4 to form the rolling tower assembly. The scaffold platform 42 is then mounted on frame 43, the platform 42 being sized to engage snugly between spaced hand rail sockets 44.

Side hand rails which form part of hand rail assembly 61 (FIG. 2) are formed from a suitable pressure flowable material such as cold rolled steel, to each include a longitudinally extending U-shaped upper side hand rail section 62 and a longitudinally extending H-shaped lower side hand rail section 63. The end portions of each of the legs of the longitudinally extending H-shaped lower sections 63 are compressed with a suitable tool (not shown) along the upper ends thereof (FIG. 5). The lower side rail H-shaped sections are then mounted on rectangular frame 43 so that the end legs nestingly engage within sockets 44 at the corners of frame 43 in fastened spaced parallel relation. The downwardly extending leg ends of legs 68 of the upper side hand rail sections 62 of U-shaped configuration are then mounted in telescoping engagement with the compressed narrower top end portions of the end legs 64 of the lower H-shaped hand rail section to form the side hand rail (FIG. 5).

The end gates 72, which also are formed from a hollow U-shaped pressure flowable material, such as cold rolled steel, are sized to extend between the spaced assembled side rail hand rail sections and provide downwardly extending legs 74 adjacent the end legs comprised of end legs 68, 64 of the upper and lower side hand rail sections 62 and 63 respectively.

These gates 72 are mounted and fastened to the side rail formed by end leg 68, 64 by forming spaced pairs of spaced detents in the form of annular beads 77 on one of the downwardly extending legs 74 of each gate 72. These annular bead detents 77 are formed by pressure flowing material of leg 74 by a tool at preselected spaced locations on leg 74 to form such spaced pairs of spaced detents.

Figure 37:
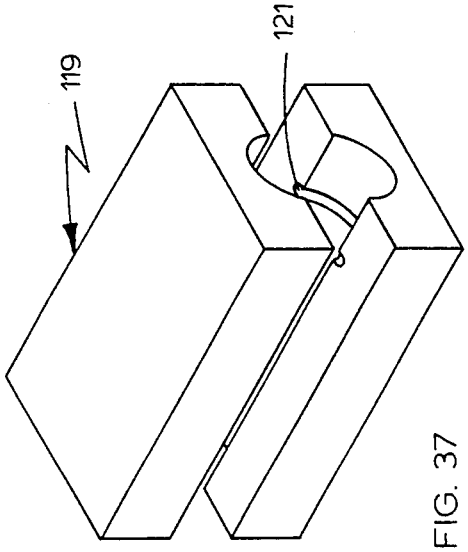
FIG. 37 is an isometric view of the novel holding or gripping tool carrying out the illustrated steps of FIGS. 35 and 36.
Figure 35:
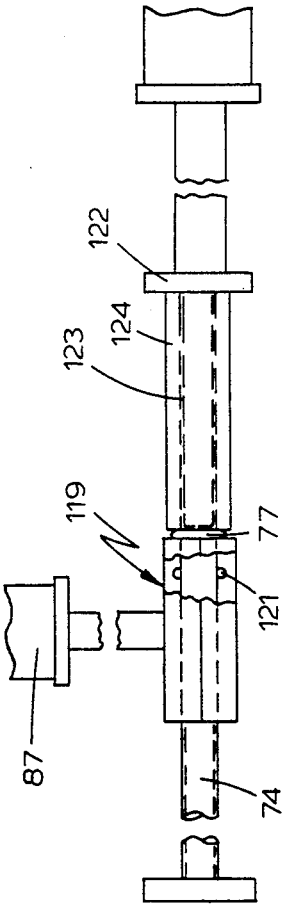
FIG. 35 is a schematic plan view of another step in the method, illustrating forming a detent in the form of an annular bead in preselected position on one of the end legs of a rolling tower hand rail assembly, such as disclosed in FIGS. 2 and 17.
Figure 36:
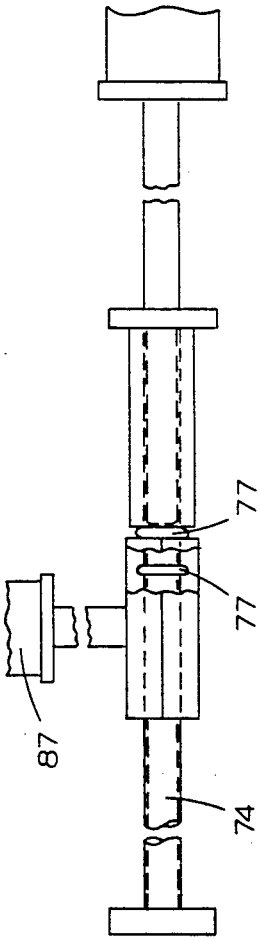
FIG. 36 is a schematic plan view similar to that illustrated in FIG. 35, illustrating a further step in forming a second spaced detent in the form of an annular bead in preselected spaced relation from the formed detent of FIG. 35.

Referring to FIGS. 35 to 37, the method steps and tool for accomplishing this is disclosed. Tool 119 is in the form of a longitudinally extending split, holding vise or clamp having a hollow internal peripheral surface sized and shaped to conform with and firmly grip the outer surface of hollow gate leg 74 with the end of the vise serving to arrest flowable material there against in formation of a detent 77 on the hollow leg 74. It is to be noted that at least one recess 121 is provided in the hollow internal surface of the split vise 119. This recess 121 is preselectively positioned therein and sized and shaped to receive a first formed detent 77 therein and to permit a second detent 77 to be formed on leg 77 to make up a second detent pair. The steps of forming the pair of detents 77 by pressure flowing the flowable material is similar to the steps in forming detents as illustrated in FIGS. 19 and 20 and FIGS. 24 and 25, in that anvil plate, mandrel and sleeve may be used. In FIG. 35, anvil plate 122 is disclosed as urged by the powered piston drive assembly 87. Anvil plate 122 has a mandrel 123 extending normally therefrom having a peripheral surface conforming with the inner peripheral surface of gate end 74. A sleeve 124 internally hollowed so as to surround mandrel 123 leaving a space therebetween to receive hollow gate end 74 is moved inwardly toward tool 119 with split portions clamping a portion of hollow rail end 74 through the aid of piston drive assembly 87. Since the wave of pressure flowable material on the peripheral surface of gate end 74 is confined by surrounding sleeve 124, the pressure flowable material flows as a wave to the end of mandrel surrounding sleeve 124 where it forms into an annular bead detent 77 against the end of tool 119. The first bead 77 on gate end 74 is then nested into recess 121 when tool 119 is opened. The tool is again closed holding the first bead 77 and a second bead 77 is formed against the end of tool 119 in a similar manner. Although it is possible to provide two spaced pairs of spaced detents 77 in the form of annular bead on hollow gate end 74, it has been found advantageous from a tooling standpoint to form only one pair of spaced detents on the U-shaped gates adjacent the lower end portion of the hollow end leg 74 to center and align the gate 72 for pivotal mounting purposes with the lower hinge hereinafter described. Suitable detent clamps (not shown) can be used for the upper hinge pivotal engagement with hollow gate end 74.

Once the at least one pair of spaced annular bead detents 77 are formed on each end gate 72, the pair of end gates 72 are mounted so that the vertical end legs 74 are adjacent the vertical legs 64, 68 of spaced, parallel side hand rail assemblies 61 (FIG. 2). Referring to FIGS. 17 and 18, hinge straps 79 having appropriately U-shaped or semi-circular ends are disposed in mirror-image relation to provide leg embracing circular ends of hinge assembly 78 with one end of each mirror strap pair being mounted between the pair of spaced detents 77 and the other end of each of said straps 79 of hinge 78 being fastened by a nut and bolt assembly 82 to the adjacent end leg 64, 68 of a side rail section 61, it being noted that the straps are fastened together along their facing intermediate sections by nut and bolt assemblies 81.

From the above, it can be seen that a novel rolling tower scaffold structure is provided, along with a novel method of forming the same and the tools associated therewith.

The invention claimed is:

1. A method of forming a ladder comprising the steps of:

forming at least one longitudinally extending rail to include spaced opposed first and second walls joined by an intermediate wall portion therebetween; said spaced opposed walls having a set of spaced opposed aligned aperture pairs disposed therein;

forming a set of hollow rungs from pressure flowable material, each of said rungs having a cross-section at at least one end portion adjacent an end extremity thereof sized to engage within said pair of spaced opposed aligned apertures in said spaced, opposed first and second rail walls;

first forming a first detent in said end portion of each of said hollow rungs a preselected distance from said end extremity thereof in excess of the distance between the outer faces of said spaced first and second walls of said rail by lineal axial pressure on said rung of pressure flowable material;

inserting each of said hollow rungs of said set of rungs through one of said pairs of spaced, opposed aligned apertures in said first and second rail walls with said first detents each abutting an outer face of one of said first and second walls and said rung extremity extending through the other of said walls; and subsequently forming by lineal axial pressure on said rung of pressure flowable material a second detent in each of said hollow rungs to compressively abut the inner face of said wall abutted on the outer face thereof by said first detent thereby compressively gripping in planar opposed face abutting relation at least one of said walls therebetween to firmly fasten said rung in position.

2. The method of forming a ladder of claim 1; said first and second detents being in the form of peripherally surrounding lineal axial pressure formed beads extending around the outer peripheries of said rungs.

3. The method of forming a ladder of claim 2; said rungs being formed with a circular cross-section and said surrounding lineal axial pressure formed beads being of annular circle shape.

4. The method of forming a ladder of claim 2; said rungs being formed with D-shaped cross-section and said surrounding lineal axial pressure formed beads being of annular D-shape.

5. The method of forming a ladder of claim 2; said rungs being formed with angular shaped cross-section and said surrounding lineal axial pressure formed beads being of annular angular shape.

6. The method of forming a ladder of claim 1; and, flaring said rung extremity extending through the other of said walls with the resulting flared end abuttingly gripping the outer face of said other of said walls.

7. The method of forming a ladder of claim 1; including forming a pair of spaced opposed longitudinally extending rails each including spaced opposed first and second walls joined by an intermediate wall portion therebetween and with opposed end portions of each hollow rung each joined to the inner wall of said first and second walls of each rail by first and second compressively gripping lineal axial pressure formed detents.

8. The method of forming a ladder of claim 1 wherein said hollow rungs which are formed from a pressure flowable material, including the steps of:

firmly clamping an end portion of said hollow rung with a clamping tool at a preselected position remote from said hollow rung extremity;

inserting a mandrel into said end portion extremity to snugly nest therein along a preselected distance, said mandrel having a peripheral outer surface conforming with the inner peripheral surface of said end portion of said rung;

applying a lineal pressure in a direction from said rung extremity and along said rung to cause a portion of said pressure flowable material of said rung to flow along said mandrel; and, arresting said flow of material at a preselected location along said rung to form said lineal axial pressure formed detent.

9. The method of forming a ladder of claim 8, including the step of confining the outer peripheral surface of said rung from said extremity of said rung along a preselected distance less than the preselected distance of said nesting mandrel.

10. The method of forming a ladder of claim 8, including the step of arresting the flow of material along said end portion of said rung at said clamping tool to provide said first detent to compressively abut the outer face of one of said rail walls in planar face abutting relation.

11. The method of forming a ladder of claim 8, including the step of arresting the flow of material along said end portion of said hollow rung to abut the inner face of said rail wall abutted on the outer face thereof by said first detent to provide said second detent in planar face abutting relation.

12. The method of forming a ladder of claim 1, wherein said hollow rungs which are formed from a pressure flowable material and the further steps of:

positioning said extremity of said end portion of each hollow rung to extend a preselected distance beyond the outer face of the other wall not gripped by said detents; and, applying pressure in a radially outward direction to the wall of said rung extremity from within said hollow rung extremity to cause the rung extremity material to flare outwardly to abuttingly engage the outer face of the other wall in planar face abutting relation to further grip said rung.

13. A method of forming at least two spaced detents in a hollow tube formed from a pressure flowable material; including the steps of:

firmly clamping an end portion adjacent an end extremity of said hollow tube at a preselected position remote from said hollow tube end extremity with a clamping mechanism having at least one detent receiving recess therein preselectively spaced from said end extremity of said clamping mechanism, inserting a mandrel into said end portion extremity of said hollow tube to snugly nest therealong a preselected distance, said mandrel having a peripheral outer surface conforming with the inner peripheral surface of said end portion of said tube;

applying a lineal pressure in a direction from said tube extremity and along said tube to cause a portion of said pressure flowable material of said tube to flow along said mandrel;

arresting said flow of material at a preselected location along said tube to form a first detent;

releasing said clamping mechanism to move said first detent into said detent recess of said clamping mechanism; and, repeating the detent forming operation to form a second spaced detent in preselectively spaced relation from said first detent.

14. A method of forming a rolling tower scaffold assembly comprising the steps of:

forming two pairs of elongated, longitudinally extending ladder rails from a pressure flowable material to each include opposed inner and outer rail walls integrally joined by at least one intermediate wall with the inner and outer walls of each rail having a plurality of spaced, aligned rung receiving apertures therein and with each rail including a plurality of preselectively positioned and sized latching apertures therein to align with latching apertures on parts to be assembled thereto including a caster box of a caster wheel and box assembly, a detent of a resilient cantilevering latching arm, a slidable carriage rail of a support platform assembly and a bottom rail of another similar assembly;

expanding a preselective bottom portion of each rail with a pair of male-female dies to pressure flow the material to expanded position;

crimping said expanded portion a preselective distance from the bottom extremity to receive in nesting telescoping relation therewith one of said caster boxes of a caster box and wheel assembly and a stacking rail of a similar assembly;

fastening one end of a cantilevering resilient spring member on the bottom end of said rail, said spring member having a detent positioned thereon to engage in aligned latching apertures in the expended bottom portion of said rail and a caster box nested therein;

forming a set of rungs for each pair of formed ladder rails from a pressure flowable material to each include opposed hollow end portions adjacent opposed extremities thereof sized to engage in said spaced, aligned rung receiving apertures in said inner and outer walls of said rails;

forming detents on said rung opposed end portions with a tool to pressure flow the surface of the end portions of said rungs to a preselected distance from said end portion extremities to form detents radially extending from the outer periphery of said hollow end portions, said detents being so positioned to abut in planar facing relation the outer faces of said inner walls of said rails allowing the end portions of said rungs to extend through both inner and outer walls of said rails;

assembling each set of rungs to said opposed rail pairs with the detents formed on the end portions abutting the outer faces of said opposed inner walls of said rail pairs in planar facing relation and the end portions extending through said inner and outer walls of each rail;

forming detents on said rung end portions along the inner faces of said opposed inner walls with a tool to pressure flow the surface of the end portions of said rungs to form detents adjacent the inner faces of said inner walls of said rails so that said detents on said outer and inner faces of said inner wall firmly grip said inner walls of said rails therebetween in compressive planar facing relation; flaring the outer extremities of the end portions of said rungs extending through the outer walls with a tool to pressure flow the material to form detents to compressively grip the outer faces of said outer walls in planar facing relation;

forming caster box and caster wheel assemblies for the bottom portion of each rail of each rail pair, said caster boxes each being formed from an integral blank including an aperture punched bottom member and latching aperture punched right angle side members sized and turned at right angles to nest with the expanded and crimped bottom portion of each rail with the bottom portion of each caster box having a pin extending therethrough to pass through a washer-stop and roller bearing sandwiched between said bottom portion and the caster wheel support to which said pin is connected;

inserting each of said caster boxes and connected caster wheel assembly into the expanded and crimped bottom portion of each rail to snugly nest therein so that the detent of said cantilevered resilient member engages in aligned latching apertures in said caster box and bottom portion of said rail and so that other locking apertures in the rail bottom portion and caster box are aligned to receive threaded nut and screw assemblies;

forming a rectangular frame to include slidable rail carriages therebelow and open hand rail sockets thereabove at each end corner thereof with spring-urged moveable latching pin pairs on said carriages;

mounting said slidable rail carriages on said rails with said latching pin pairs on said carriages adjustably engaging in said latching apertures on said rails to form said rolling tower;

mounting a scaffold platform on said rectangular frame sized to snugly extend between said hand rail sockets;

forming a pair of side hand rails of pressure flowable material so that each rail includes a longitudinally extending U-shaped upper section and a longitudinally extending H-shaped lower section;

compressing the end portions of each of said end legs of said longitudinally extending H-shaped lower sections with a tool along the upper ends thereof;

mounting each of said lower side rail sections on said rectangular frame to nestingly engage with said sockets on said frames in fastened spaced parallel relation;

mounting said upper hand rail sections with the downwardly extending end legs in telescoping engagement with said compressed narrower upper ends of said end legs of said lower hand rail sections to form spaced, parallel side hand rails;

forming end gates from a U-shaped pressure flowable material sized to extend between said spaced, parallel assembled side hand rail sections, each end gate being formed to provide downwardly extending legs to be positioned adjacent end legs of said spaced, parallel side hand rails;

forming at least one pair of spaced detents in one leg of each of said end gates by pressure flowing material of said leg by a tool at preselected spaced locations on said leg to form said spaced pair of detents and mounting said end gates so that the vertical downwardly extending end legs thereof are adjacent the vertical legs of said side hand rail vertical legs; and, fastening hinges to said adjacent gate and side rail legs, each hinge being formed from a pair of mirror-image connected straps shaped to provide leg embracing ends with one end of each of said strap pairs being mounted between a pair of spaced detents to pivotally embrace said leg and the other end of each of said straps embracing an adjacent leg and being fastened thereto.

* * * * *